US005255405A

United States Patent [19]

Samuelsson et al.

[11] Patent Number: 5,255,405

[45] Date of Patent: Oct. 26, 1993

[54] TOOL HOLDING APPARATUS

[75] Inventors: Soren Samuelsson, Palm Desert; Patrick A. Smahlik, Pleasanton, both of Calif.

[73] Assignee: Steccone Products Co., Oakland, Calif.

[21] Appl. No.: 784,477

[22] Filed: Oct. 30, 1991

[51] Int. Cl.[5] ..... B25G 3/38

[52] U.S. Cl. ..... 15/144.1; 15/245; 116/110

[58] Field of Search ..... 15/144.1, 121, 118, 15/245; 116/110 R

[56] References Cited

U.S. PATENT DOCUMENTS

| | | | |
|---|---|---|---|
| D. 298,072 | 10/1988 | Stirling . | |
| 503,888 | 8/1893 | Wiebush | 15/121 |
| 590,751 | 9/1897 | Clarke et al. | 15/144.1 X |
| 834,667 | 10/1906 | Flynn | 15/121 |
| 936,150 | 10/1909 | Nelson | 15/144.1 X |
| 3,129,970 | 4/1964 | St. John | 15/144.1 X |

FOREIGN PATENT DOCUMENTS

| | | | |
|---|---|---|---|
| 39089 | 3/1927 | Denmark | 15/144.1 |
| 7363 | of 1892 | United Kingdom | 15/144.1 |
| 1150015 | 4/1969 | United Kingdom | 15/121 |

*Primary Examiner*—Frankie L. Stinson
*Attorney, Agent, or Firm*—Kathleen A. Skinner

[57] ABSTRACT

A tool holding apparatus for use with extension poles has a substantially hollow longitudinal handle for mounting on an end of an extension pole. A tubular support member is rotatably engaged with the upper end of the handle and is rotatable about an axis perpendicular to the longitudinal axis of the handle. The tubular support member has tool-engaging means on at least one end for supporting a tool. Means for rotating the tubular support member relative to the handle are provided. The device also includes stop means disposed on the outer wall of the handle for limiting the rotation of the tubular support member beyond a predetermined point.

14 Claims, 5 Drawing Sheets

TOOL HOLDING APPARATUS

BACKGROUND OF THE INVENTION

1. Field of the Invention

The present invention relates to the field of cleaning implements and tools and, more particularly, to an apparatus to hold tools when using an extension pole.

2. Description of the Prior Art

Window cleaners and other professionals, such as painters, frequently must perform their work where the surface to be treated is considerably out of their reach and where ladders cannot be used efficiently. Typically, a window cleaner will use a cleaning tool to first wet the surface of the window and loosen any dirt or debris thereon. This tool may consist of a support bar mounted on a handle to which a removable cloth or absorbent cover is secured. A squeegee is then used to wipe the window dry by applying the blade edge of the squeegee to the wet surface and drawing the blade under pressure at an angle along that surface, removing the moisture behind it. This use of the wetting/cleaning tool and the squeegee is usually alternated for each window. When the windows are located several stories high, the squeegee and cleaning tool can only be used without an extension ladder by mounting them on an extension pole, which is typically a lightweight aluminum or plastic pole with telescoping sections which can be extended several stories above the ground. Although many squeegees and related cleaning implements are designed to fit onto the end of extension poles, the process of using these implements with an extension pole is awkward and time consuming since either the extension pole must be brought down to the cleaner every time the tool is alternated or two extension poles must be used simultaneously.

Furthermore, the cleaning process is much more difficult at an elevation because the squeegee and other cleaning tools need to be applied with pressure at an angle to the surface in order to be effective, and to achieve the proper angle and pressure, a window cleaner may have to position himself with the lower end of the extension pole some distance from the structure. This can be dangerous if it requires the window cleaner to step away from the building into traffic or if hilly terrain or landscaping do not allow sufficient distance to work. Greenhouse windows are also frequently difficult to reach from conventional positions. Other architectural detailing such as projecting window sills also make it difficult or impossible to properly clean the window from top to bottom because the sills interfere with the full stroke of the squeegee. In some situations the windows cannot be properly cleaned at all with extension poles and tools currently available for use.

Squeegees and cleaning tools are available with handles which swivel relative to the squeegee blade or to the support bar for the cleaning material, for example, those shown in U.S. Design Patent Nos. 296,946 and 298,072. The swivel-handled feature of both of these tools, which allows the squeegee user to rotate the squeegee blade relative to the handle, allows the user to develop a cleaning technique in which, the squeegee or cleaning tool is smoothly and quickly moved across the surface of the window in horizontal and vertical strokes without being removed from the surface. Although these tools provide more versatility in cleaning windows several stories high, such swivel-handled devices only permit rotation in the plane of the handle and do not rotate relative to their up and down contact with the surface of the window.

Accordingly, there has been a need for a device which allows the squeegee and cleaning tool to be mounted,.on the same pole so that one need not be removed from the pole in order to alternate use with the other. There has also been a need for a device which makes it possible to use a squeegee or a cleaning tool with the proper angle when such implement is used on an extension pole at a considerable distance from the window cleaner's reach. Although one prior art device, illustrated in FIG. 7, shows a cleaning tool attached to a squeegee, this cannot be used below overhanging surfaces or in corners, nor can it be used for a full vertical stroke if there is a part of the frame or other obstruction below the window, as seen in FIG. 8.

The present invention provides an apparatus which can be used to hold two tools at the end of an extension pole at the same time so that it is not necessary to retract the extension pole to change the tool during the course of the cleaning procedure. This invention also allows the user to easily achieve the proper angle with window cleaning tools relative to the window surface so that greenhouse windows and windows with projecting sills and below overhangs can be cleaned thoroughly and relatively easily, without the need for the window cleaner to be distanced so far from the structure. This invention also makes it possible to clean windows or reach surfaces more than two stories high from a starting position which is closer to the building, thereby reducing risk from traffic and terrain and making it possible to clean some windows which could not previously be cleaned well at all by an individual window washer. Thus, the present invention provides an unique solution to the problems of window washers and provides more versatile use of window washing tools at the ends of extension poles. The present invention can also be adapted to the tools of other professionals, such as painters, who also, need to be able to thoroughly reach surfaces in high or awkward locations.

SUMMARY OF THE INVENTION

The present invention is a tool holding apparatus which has a hollow longitudinal handle for mounting onto the end of an extension pole. A tubular support member is rotatably engaged with the upper end of the longitudinal handle whereby it will rotate in the same plane as the handle about an axis which is perpendicular to the longitudinal axis of the handle. The tubular support member has tool-engaging portions on at least one end for engaging the handle of a tool, such as a squeegee. The rubber end of the squeegee or the operative end of a cleaning tool can then be caused to contact a surface which is transverse to the tubular support member. The invention includes means for rotating the tubular support member relative to the handle and accordingly allows the user to change the angle at which the tool is presented to the windows or other surface without significantly changing the position of the extension pole. Stop means are disposed on the outer wall of the handle to limit the rotation of the tubular support member beyond a pre-determined point. The stop means includes at least one bracket slidably mounted longitudinally on the handle wall with a stop projecting from one end of the bracket into the path of rotation of the tubular support member. Thus, the present invention provides a tool holding apparatus with a rotatable handle which can be mounted at the end of an extension pole and which will support one or two tools mounted thereon and enable each tool to be used, alternatively, through its full range of motion to wash and dry a window or other surface located at a height or some distance from the user. This invention also provides the user with more versatility in the motions which can be used to clean a surface more efficiently and safely from an extended distance and makes it possible for the first time, to clean some surfaces completely without a ladder or high rise equipment.

Other objects and advantages of the invention will become apparent from consideration of the following description taken in connection with the accompanying drawings.

DESCRIPTION OF THE PREFERRED EMBODIMENT

Figure 2:
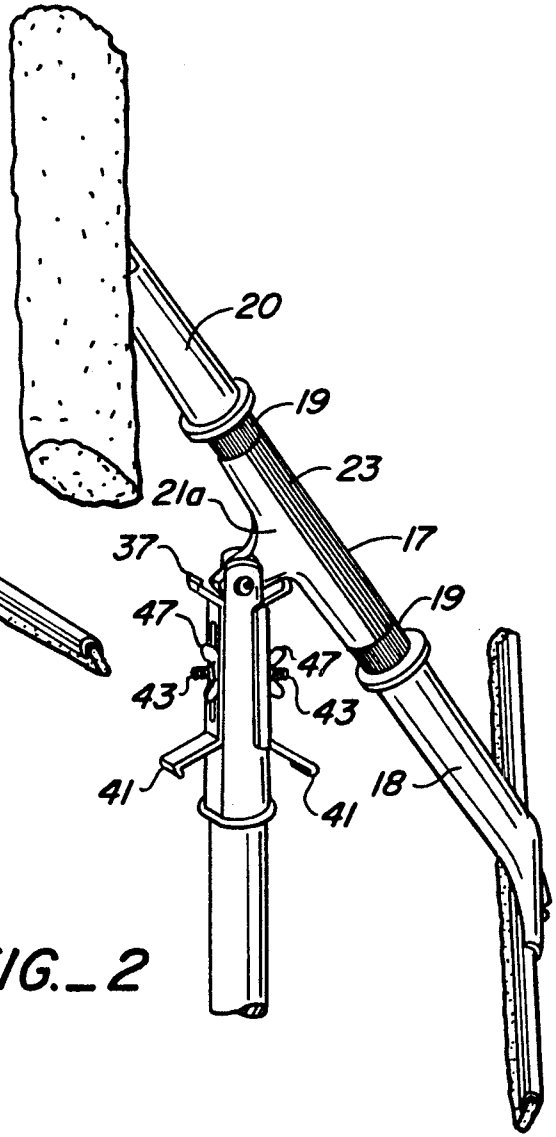
FIG. 2 is a perspective view of the invention shown in FIG. 1 with the invention in a swiveled position.

The present invention is a tool holding apparatus 11 having a longitudinal handle 13 which is substantially hollow and has an upper end 13*a* and a lower end 13*b* for receiving and securing an end of a pole 15 inserted into the lower open end of the handle. The handle may be similar to the handle of any tool which is typically mounted on an extension pole. In the preferred embodiment, however, the handle is tapered with an increasing inner diameter from its upper end to its lower open end so that an extension pole inserted into the open end will be pushed inwardly and wedged therein. Typically, the interior surface of such a handle also contains a plurality of longitudinal ridges which increase the wedging effect on an extension pole inserted into the handle, particularly if the inserted end of the extension pole contains a surface which mates with these internal ridges. In the preferred embodiment, the handle used for the tool holding apparatus is that illustrated in U.S. Design Patent No. 298,072. The longitudinal handle can be constructed of ABS plastic or any hard rigid plastic which is durable for use with squeegees and similar implements.

A tubular support member 17 is rotatably engaged with the upper end 13*a* of the handle 13 and is disposed with its longitudinal axis transverse to the longitudinal axis of the handle. When the tubular support member is not in a rotated position relative to the handle, the tool holding apparatus will generally have a T-shaped configuration, with the tubular support member forming the top of the "T". The tubular support member has tool-engaging means on at least one of its ends, and preferably on both ends, for engaging the handle of a tool such as a squeegee 18 or a cleaning tool 20. The tubular support member, as mentioned, is rotatably engaged with the upper end of the longitudinal handle and is rotatable about an axis which is perpendicular to the longitudinal axis of the handle. The tubular support member rotates in the same plane as the longitudinal handle; but the longitudinal axis of the tubular support member is generally transverse to the longitudinal axis of the handle. The tubular support member could be constructed so that it would be directly connected to the means for rotating the tubular support member relative to the handle, but in the preferred embodiment, the tubular support member is supported by a base member 21 which is attached to the longitudinal handle. The base member is generally T-shaped and secured to the upper end 13*a* of the handle. It has a trough-like portion 21*a* for supporting the tubular support member and a handle-engaging portion 21*b* projecting perpendicularly from the trough-like portion and secured to the upper end of the longitudinal handle. Since the tubular support member is securely mounted longitudinally to the trough-like portion of the base member in a nesting relationship, the base member and the tubular support member will swivel or rotate as a unit relative to the longitudinal handle.

Figure 3A:
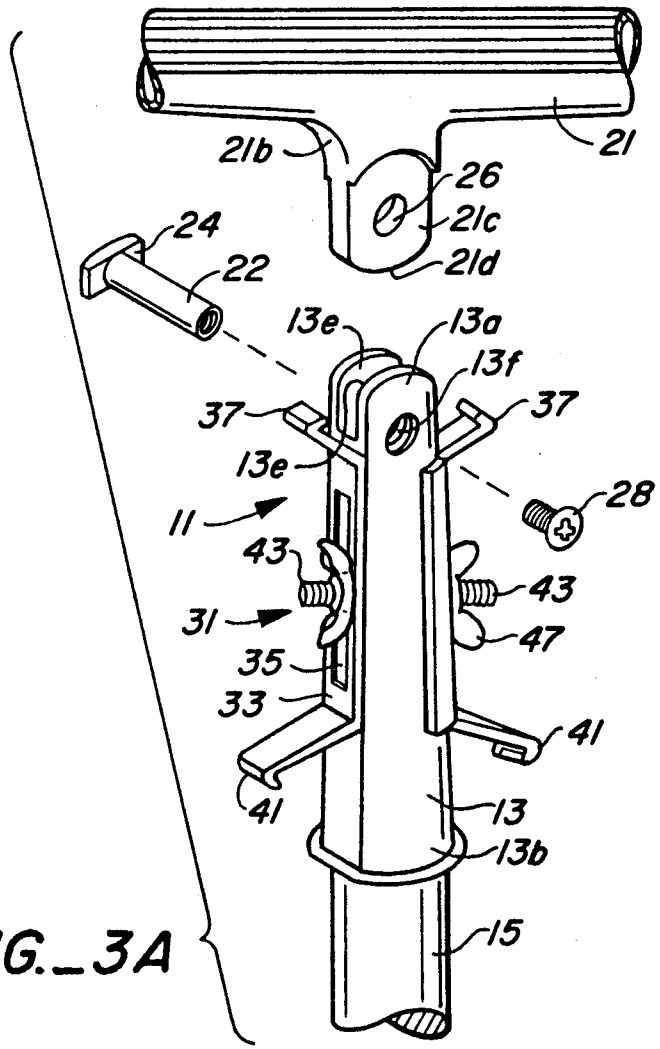
FIG. 3A is a perspective view of the invention shown in FIG. 3 with the rotatable means disassembled.
Figure 3:
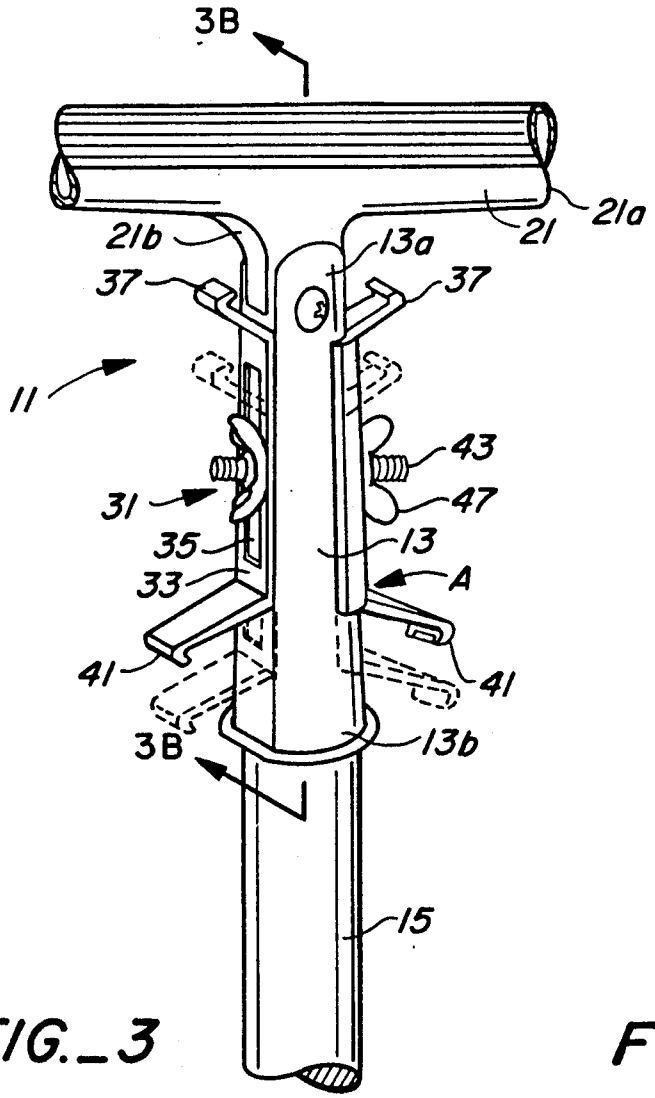
FIG. 3 is another perspective view of the tool holding apparatus of this invention with portions of the tubular support member cut away and illustrating alternative positions of brackets in phantom.
Figures 3B, 3C, 3D:
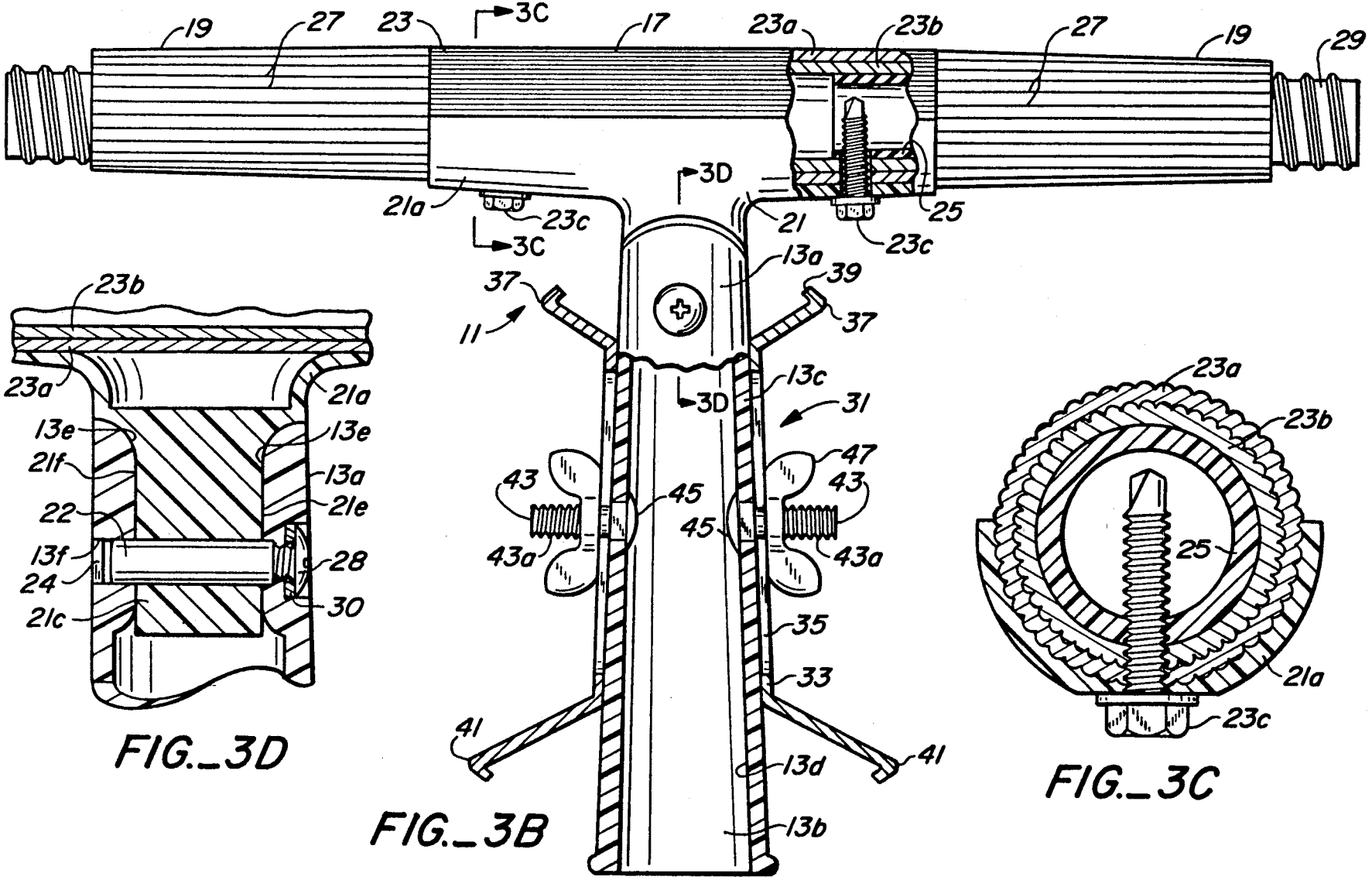
FIG. 3B is a front elevational view of the invention with a partial cross-sectional view taken along line 3B—3B in FIG. 3.
FIG. 3C is an enlarged cross-sectional view of FIG. 3B taken along line 3C—3C.
FIG. 3D is an enlarged cross-sectional view of FIG. 3B taken along line 3D—3D.

The means for rotating the base member 21 and the tubular support member 17 relative to the handle 13 can be any known mechanism which allows the base member to rotate or pivot around the end of the handle. In the preferred embodiment of this invention, the base member and the swivel mechanism employed are the type illustrated in Design Patent No. 298,072. As can be seen in FIGS. 3A and 3D, the handle-engaging portion 21*b* of the base member 21 consists of a projecting tongue 21*c* with a curved outer end 21*d*, flat top surface 21*e* and bottom surface 21*f*, and an opening 26. This tongue is inserted in a sandwiched manner between the walls 13*e*, 13*e* of a groove cut out of the upper end 13*a* of the longitudinal handle 13. The groove has a recess at its inner end which receives the curved end of the tongue of the base member. An internally threaded cylindrical member 22 with a locking head 24, which is secured to the exterior surface of one wall 13*e* of the handle 13, extends through an opening 13*f* in the first exterior wall 13*e*, through the opening 26 in the tongue 21*c* and into an opening 13*f* in the second wall 13*e* where a screw 28 inserted through this second wall 13 of the handle is threaded into the member 22. This fastener assembly locks the tongue of the base member between the walls of the longitudinal handle in a manner which allows the tongue to rotate about the cylindrical member. The tension of this fastener arrangement, which affects the ease of rotation of the base member, can be increased by using a washer 30 or the like and can be adjusted by tightening or loosening the screw.

Figure 1:
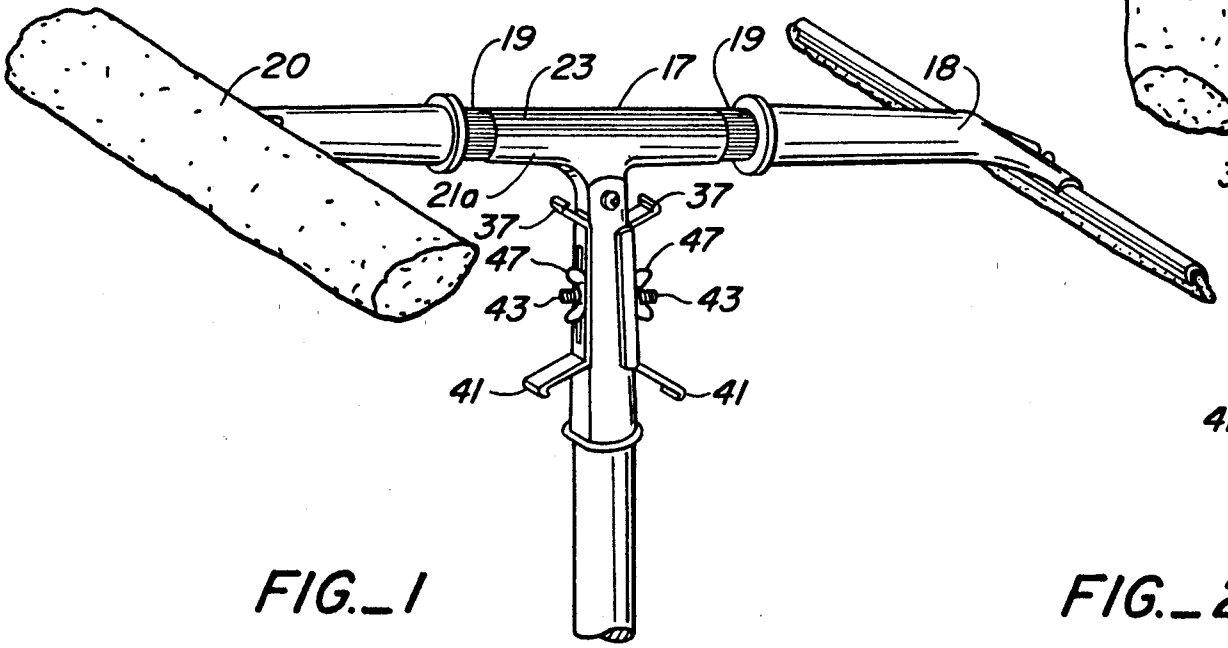
FIG. 1 is a perspective view of the tool holding apparatus of this invention with two typical tools mounted thereon.

The tubular support member 17 preferably comprises a metal portion 23 which is secured to and co-extensive with the trough-like portion 21*a* of the base member 21. The lighter weight tool-engaging portions 19, 19 abut the ends of the metal portion. The metal portion preferably comprises a double layer of serrated aluminum 23*a*, 23*b* of a length at least as long as the trough-like portion of the base member in order to provide durability for the tubular support member. Considerable torque is experienced by the tubular support member when a long squeegee and a cleaning tool bearing a wet cover as seen in FIG. 1 are mounted on the tool holding apparatus and it is used several stories above ground. It has been found that this double layer of serrated aluminum used at the inner section of the tubular support member provides a great deal of strength to the tool-holding apparatus but the apparatus still remains lightweight, which is desirable for a tool used at an extended distance. Each tool-engaging portion 19, which may be made from sturdy ABS plastic, has an exterior surface which generally abuts the exterior surface of the metal portion. Each tool-engaging portion has a projecting inner end 25 which has an outer diameter sized to fit snugly inside the inner metal portion 23*b* of the tubular support member. This inner projecting end portion 25 of a tool-engaging portion 19 is press-fitted into the inner layer 23*b* of the double metal portion of the tubular support member which is then mounted on the trough-like portion 21*a* of the base member 21. Sturdy countersinking screws 23*c* such as sheet metal screws with hex-heads are driven through the base member 21, the double layer of metal 23*a*, 23*b* and the inner portion 25 of the tool-engaging member to anchor these parts together and insure against breakage of the invention, which breakage can occur easily if the tool holding apparatus is subjected to severe conditions from an extended distance on an extension pole.

The length of each tool-engaging portion 19, 19 preferably extends for at least as long as the length of the hollow interior portion of a typical squeegee handle or the handle of a cleaning tool. Each tool-engaging portion is preferably tapered to have a greater outer diameter at its inner end proximate the metal portion 23 of the tubular support member 17 than at its outer end. Thus, the outer end of the tool-engaging portion can be slid into the hollow handle of a squeegee, for example, to wedge the tool-engaging portion into the hollow handle so that the tool fits securely on the end of the tubular member. The exterior surface of the tool-engaging portions includes a plurality of longitudinal ribs or ridges 27 which engage the interior surface of the handle of a tool which is mounted on its end. These ridges may be adapted to especially fit with the interior ribs typically found on the handles of squeegees and cleaning tools, such as those shown in Design Patent Nos. 298072 and 296946. The resulting mating effect will enhance the locking feature of the tool handle on the end of the tubular support member, even when it is used at a very high elevation. The tool-engaging portion of the tubular support member may, at its outer end, also include a threaded portion 29 which is sized to fit the internal threads of standard paint rollers and other tools, thus allowing this swivel handled tool-holding apparatus to be useful by painters and others as well as window cleaners.

Figure 6:
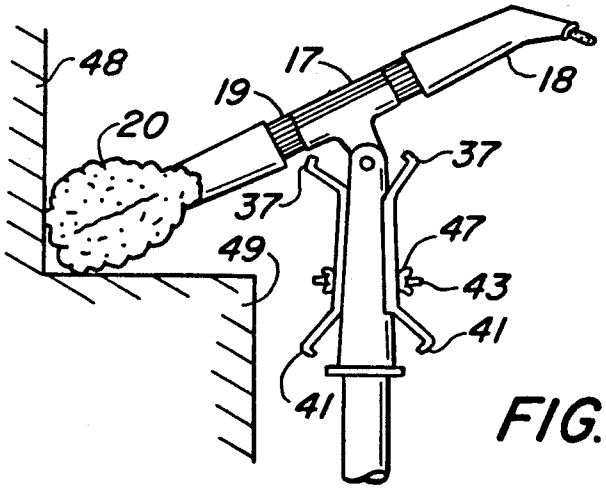
FIG. 6 is a front elevational view of the invention with the cleaning tool at the bottom of a window cleaning stroke.

The swivel mechanism providing the rotational means for the handle 13 and the base member 21 can be adjusted fairly tightly to control the degree of rotation of the tubular support member and therefore the range of movement of the particular tool, but it is desirable to adjust the tension of the swivel assembly so that it moves easily along the surface of the window. The range of the tool is then stopped by stop means, which are disposed on an outer wall 13*c* of the handle for limiting the rotation of the tubular support member beyond a predetermined point. The stop means comprises at least one bracket 31 slidably mounted longitudinally on an outer wall of the handle. The bracket has a bracket base 33 with a slot 35 disposed longitudinally therethrough and a stop 37 projecting from at least one end of the bracket base at an angle into the path of rotation of the tubular support member. The stop may be an arm or a flange 37 integrally formed from the bracket by bending the end of the bracket nearest the base member 21 to create a projecting arm. This angled projection 37 may further have a bend or an end member 39 at the end thereof to form a curved point of contact with the base member. Since a tool may be mounted on each end of the tubular support member, brackets with stop members are disposed on opposing sides of the exterior wall 13*c* of the handle 13 so that the range of rotational motion available to each tool mounted on an end of the tubular support member may be adjusted and pre-set by the window cleaner before the tool holding apparatus 11 is mounted on the extension pole 15 and raised a considerable distance from the user. For additional versatility, for example, for use with squeegees having a longer channel, an additional pair of stops 41, 41 having a different length from the first pair 37, 37 are provided at the other ends of the bracket bases. The bracket is also releasably mounted to the wall of the longitudinal handle so that the bracket can be reversed end for end to alternate the stops (and the length of the stops) which project into the path of rotation of the tubular support member and the base member. The length of each stop and the angle from which it projects from the bracket can be selected based on the environment of the surface to be cleaned, the configuration of the tool to be used, the size and typical range of the tool to be used and the preference of the window cleaner. In one embodiment, for example, two stops 37, 41 are used on each bracket, one stop 37 having a length of approximately ⅝" and the other stop 41 a length of 1¼"; the stops on each bracket are angled outwardly from the bracket base in an obtuse angle A which is approximately 120°. These lengths are only samples of stops which can be employed in the invention. The size of angle A can also vary, but for most uses it will be between 110° and 130°. The bracket may be released and reversed so that the longer stop 41 is closer to the base member, or vice versa, and the bracket may be moved along the length of the handle to place the stops closer or farther away from the handle as illustrated in FIG. 3, making numerous variations and adjustments possible with each bracket constructed. Generally, the greater the projecting window sill 49, the steeper the angle that is necessary to allow the squeegee to reach the bottom of the window, as is illustrated in FIG. 6. The tubular support member 17 will be rotated as the tool is moved across the surface of an elevated window but will be stopped from excessive rotation which could lock the tool in place and prevent it from being readjusted while in place on a pole 15.

The bracket base 33 may be of any convenient length. The bracket base includes a longitudinal slot 35 which extends generally from one end of the bracket to the other. The bracket may be slid along the handle 13 for the length of the slot to any desired position. Each of the brackets is mounted to the handle by a fastener 43 which has a flat head portion 45 secured to the inside wall 13*d* of the longitudinal handle 13 and a threaded portion 43*a* projecting through the handle wall and the bracket slot 35 and secured in place by a releasable locking member 47 mounted to the threaded portion on the exterior of the wall. It is important that the interior of the longitudinal handle be hollow and generally unobstructed, allowing the end of the extension pole to be fully inserted into the handle and wedged tightly into place so that when the pole is raised to a high elevation, the tool holding apparatus will not be dislodged and pose a risk of injury to those below. Although a single fastener could be used which would pass transversely through the hollow opening of the handle and connect both brackets together, such a fastener reduces the space needed for the upper end of the pole 15 and it is preferred that the fastener have a generally flat head 45 and be mounted through only one wall. In the preferred embodiment, a self-tapping PEM stud with a serrated head and threaded end is permanently anchored in the handle. The bracket is releasably mounted on the fastener and is secured thereto with a hand-releasable locking member 47, such as a wing nut, mounted to the threaded portion on the exterior of the handle. With this embodiment, no additional tool is necessary to easily release and adjust the location of the bracket and its stops to set the pre-determined stopping point in the rotation of the tubular support member.

Thus, this invention can be used by a professional window cleaner and others to more efficiently and advantageously reach and clean windows or other surfaces in situations where extension poles are necessary, and especially in cases where it is difficult to apply a squeegee or other tool at the proper angle or pressure by extension pole. The tool-holding apparatus of this invention can be placed on the end of an extension pole and a scrubbing applicator can be mounted on one tool-engaging portion and a squeegee on the other, for instance.

Figure 8:
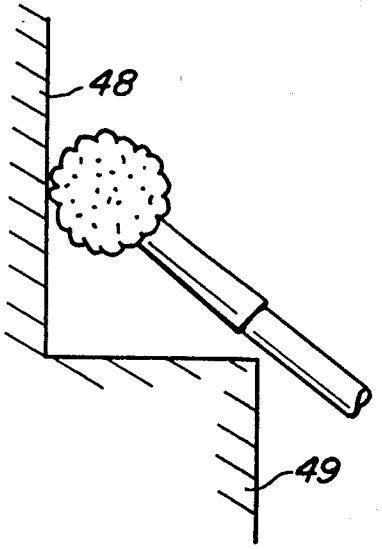
FIG. 8 (PRIOR ART)
FIG. 8 is a side elevational view of a typical prior art cleaning device mounted directly onto an extension pole.

For higher windows, particularly for those with projecting sills or surfaces 49, such as is illustrated in FIGS. 6 and 8, it is preferred that a squeegee such as that disclosed in U.S. Pat. No. 4,611,363 be used. This adjustable squeegee allows the width of the rubber projecting from the channel to be increased, for certain applications, thereby reducing the amount of pressure which must be applied to the squeegee in the latter part of a vertical stroke. This ability becomes more important as the squeegee is used on higher windows 48 which have large sills 49 when the angle on the squeegee must be relatively steep.

Figure 5:
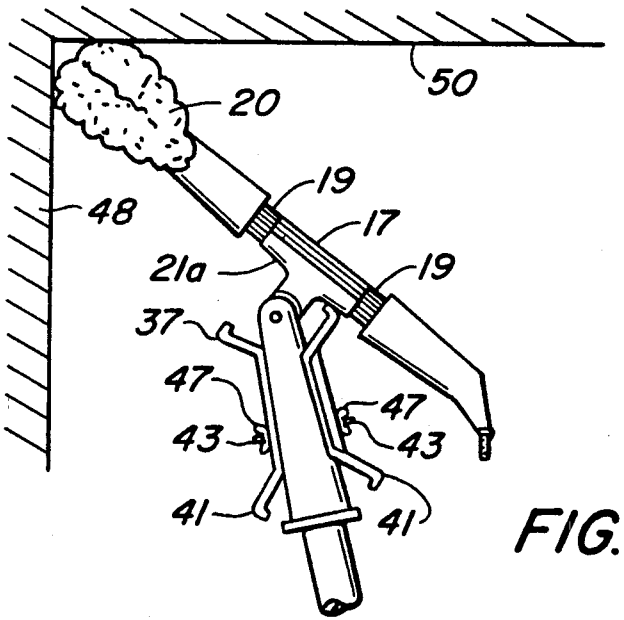
FIG. 5 is a front elevational view of the invention of FIG. 1 with a cleaning tool in operative position, at the top of a window cleaning stroke.
Figure 7:
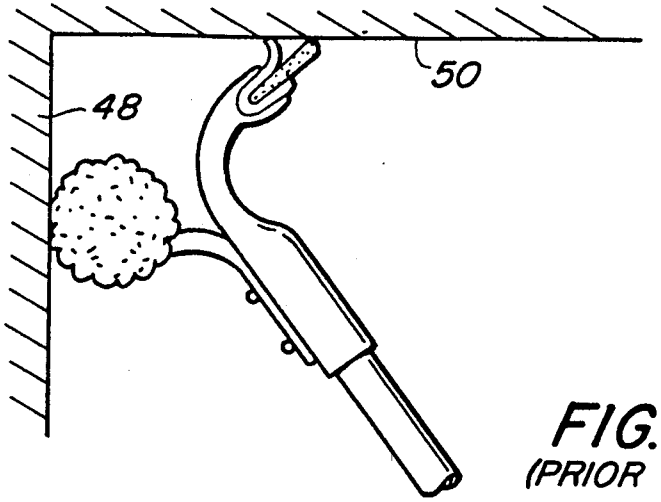
FIG. 7 (PRIOR ART)
FIG. 7 is a side elevational view of a prior art device of a squeegee with a cleaning tool mounted on the squeegee.

The range of movement which will be desired with each tool in each particular situation can be roughly determined from experience or trial and error and the stop means can be adjusted. The bracket can be released and slid along the handle or reversed to place a different length stop closer to the base member and the locking member can be re-tightened. The tool holding apparatus can then be raised on the extension pole to the work surface desired. With this invention the cleaning tool 20 can be used to reach into the upper corners of the window 48, even if there is an overhang as seen in FIG. 5 and it can clean all the way to the bottom as seen in FIG. 6. The extension pole 15 can then be rotated and touched against a surface to switch the squeegee 18 to its starting position where it will also be drawn down to dry the surface from top to bottom. This provides a substantial advantage over prior art devices, such as that shown in FIG. 7 in which the squeegee is mounted to the cleaning tool on the same pole in a fixed position. With that device, neither tool can reach the upper corner, nor provide a complete vertical stroke, if there is an overhang or a sizable sill. With the subject invention the squeegee or tool can be used to reach into the upper corners of windows or other surfaces to be cleaned even though there are overhanging surfaces, thereby allowing a high window to be cleaned all the way from the top down to the bottom frame. This device also allows the squeegee to get closer to the bottom of the window without hitting the frame first, which occurs with tools mounted conventionally on extension poles as seen in FIG. 8.

Because the angle of the tool may be adjusted to accommodate to the surrounding architecture of the window to be cleaned, rather than requiring the window cleaner holding the extension pole to adjust his position to reach a better angle, it is now possible to use the extension pole at a position closer to the structure and allow the user to complete the cleaning stroke without having to change his position and move to a much greater distance from the building. This is particularly advantageous in an area where there are obstacles at a distance from the building or in a heavy traffic area. Because the starting position is closer to the building, it is also possible to reach higher with this tool holding apparatus on the pole than with a typical squeegee mounted directly onto an extension pole without this invention. Furthermore, with this invention, and particularly when used with an adjustable squeegee such as disclosed in U.S. Pat. No. 4,611,363, it is possible to clean a window all the way to the bottom in circumstances, such as illustrated in FIG. 6, where an obstruction requires a severe angle on the squeegee.

Figure 4:
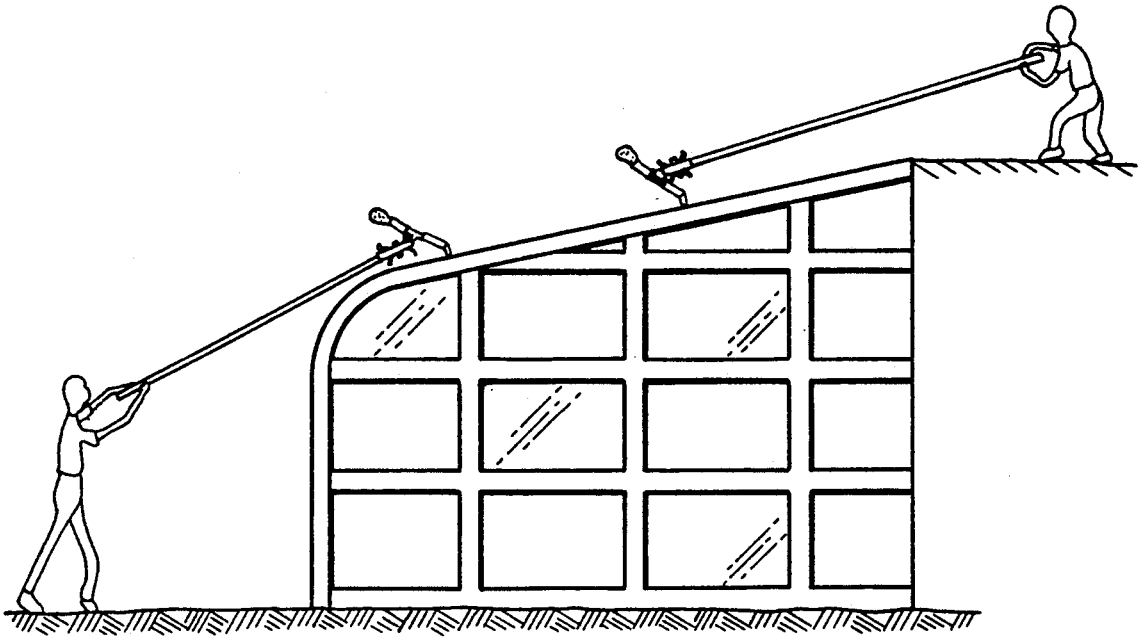
FIG. 4 is a front elevational view illustrating one advantageous application of an extension pole equipped with the tool holding apparatus of this invention in use in cleaning greenhouse windows.
Figure 4A:
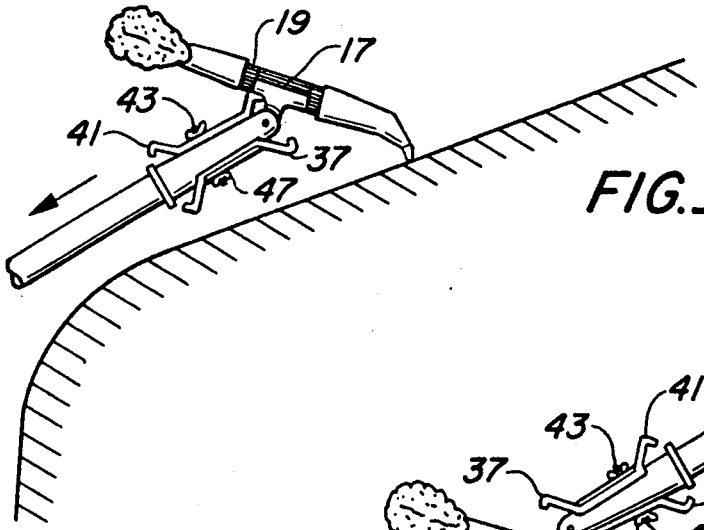
FIG. 4A is a front elevational view of the tool holding apparatus of the invention with a squeegee in operative position and being pulled across a surface as illustrated in the left portion of FIG. 4.
Figure 4B:
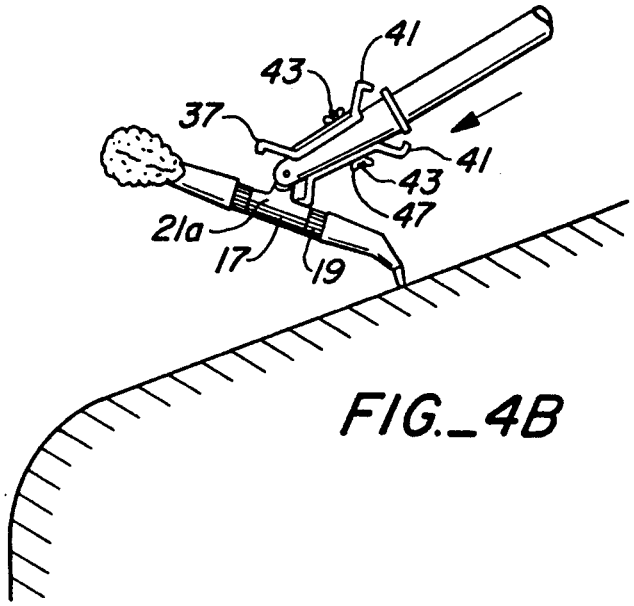
FIG. 4B is a front elevational view of the invention of FIG. 4A with the squeegee being pushed along the surface as illustrated in the right portion of FIG. 4.

This invention also provides greater versatility in cleaning greenhouse windows and other down-sloping surfaces as can be seen in FIG. 4. In this situation, it is possible to first stand in a higher location and apply the squeegee with a pushing mechanism, as seen in FIG. 4B, and then to stand below, reverse the position of the squeegee on the tool and clean the lower windows with a pulling movement, as seen in FIG. 4A.

Thus, it can be seen that the tool-holding apparatus of this invention provides greater versatility and efficiency to a professional window cleaner by merely mounting the tool-holding apparatus of this invention on the end of an extension pole and using it in conjunction with a standard squeegee, particularly an adjustable squeegee, a cleaning device or other tool.

Various modifications and changes may be made with respect to the foregoing description without departing from the spirit of the present invention. For example, the lengths and angles of the stops, the dimensions of the bracket, etc., may be varied for additional purposes. From the foregoing, it will be apparent that the tool-holding apparatus of the present invention provides a means to easily use more than one tool and reduce the steps employed in cleaning a window conveniently and with means for adjusting the apparatus for the particular conditions of any individual project.

We claim:

1. A tool holding apparatus comprising a longitudinal handle being substantially hollow and having an upper end and a lower open end for receiving and securing an end of a pole inserted into said lower open end;

a tubular support member rotatably engaged with the upper end of said handle, said tubular support member being disposed with its longitudinal axis transverse to the longitudinal axis of said handle and rotatably about an axis perpendicular to the longitudinal axis of the handle, said tubular support member having tool-engaging means on at least one end thereof for engaging a handle of a tool;

a generally T-shaped base member secured to the upper end of said handle, said base member having a trough-like portion for supporting the tubular support member and a handle engaging portion projecting perpendicularly from said trough-like portion, said handle engaging portion being secured to the upper end of the longitudinal handle;

means for rotating said tubular support member relative to said handle; and stop means disposed on an outer wall of said handle for limiting the rotation of the tubular support member beyond a predetermined point.

2. The tool holding apparatus of claim 1 wherein the tubular support member comprises a metal portion secured to the trough-like portion of the base member and tapered tool-engaging portions disposed at each end of said trough-like portion, the outer diameter of the tool-engaging portion being greater at its inner end proximate the metal portion of said tubular support member and narrower at its outer end.

3. The tool holding apparatus of claim 2 wherein the metal portion of said tubular support member is co-extensive with the trough-like portion of the base member and the exterior surface of the tool-engaging portions comprises a plurality of longitudinal ribs to engage the interior surface of a handle of a tool mounted on said tool-engaging portion.

4. The tool holding apparatus of claim 2 wherein the outer end of each tool-engaging portion of the tubular support member comprises a threaded portion.

5. A tool holding apparatus comprising a longitudinal handle being substantially hollow and having an upper end and a lower open end for receiving and securing an end of a pole inserted into said lower open end;

a tubular support member rotatably engaged with the upper end of said handle, said tubular support member being disposed with its longitudinal axis transverse to the longitudinal axis of said handle and rotatable about an axis perpendicular to the longitudinal axis of the handle, said tubular support member having tool-engaging means on at least one end thereof for engaging a handle of a tool;

means for rotating said tubular support member relative to said handle; and stop means disposed on an outer wall of said handle for limiting the rotation of the tubular support member beyond a predetermined point, said stop means comprising at least one bracket slidably mounted longitudinally on an outer wall of said handle, said bracket having a stop projecting at an angle from at lest one end of said bracket into the path of rotation of said tubular support member.

6. The tool holding apparatus of claim 5 wherein said bracket has a bracket base with a slot disposed longitudinally therethrough and a stop projecting from each end of said bracket base, said stops having different lengths, said bracket base being releasably mounted to the wall of the longitudinal handle and reversible end-for-end so that said bracket base can be alternated to vary the length of the stop projecting into the path of rotation of the tubular support member.

7. A tool holding apparatus comprising a longitudinal handle being substantially hollow and having an upper end and a lower open end for receiving and securing an end of a pole inserted into said lower open end;

a generally T-shaped base member secured to the upper end of said handle, said base member having a trough-like portion and a handle engaging portion projecting perpendicularly from said trough-like portion, said handle engaging portion being secured to the upper end of the longitudinal handle and being rotatable about an axis perpendicular to the longitudinal axis of the handle;

a tubular support member mounted longitudinally on the trough-like portion of the base member and rotatable with said base member relative to said handle, said tubular support member having tool-engaging portions disposed at each end thereof for engaging a handle of a tool;

means for rotating said base member relative to said handle; and a pair of brackets slidably mounted longitudinally on opposite walls of said handle, each of said brackets having a stop projecting at an angle from said bracket into the path of rotation of the base member to limit the rotation of the tubular support member beyond a predetermined point.

8. The tool holding apparatus of claim 7 wherein the tubular support member comprises a reinforced metal portion secured to the trough-like portion of the base member and the tool-engaging portions are tapered, the outer diameter of each tool-engaging portion being greater at its inner end proximate the metal portion of said tubular support member and narrower at its outer end.

9. The tool holding apparatus of claim 8 wherein the metal portion of said tubular support member comprises a double layer of serrated aluminum for at least the length of the trough-like portion of the base member and the tool-engaging portions have an outer surface which abuts the outer surface of the metal portion and a projecting inner end portion having an outer diameter sized to fit securely inside the metal portion, said metal portion, the inner end of said tool-engaging portion and said base member being tightly secured together with self-locking fastener.

10. The tool holding apparatus of claim 8 wherein the exterior surface of the tool-engaging portions comprises a plurality of longitudinal ribs to engage the interior surface of a handle of a tool mounted on said tool-engaging portion.

11. The tool holding apparatus of claim 8 wherein the outer end of each tool-engaging portion of the tubular support member comprises a threaded portion.

12. The tool holding apparatus of claim 7 wherein each of said brackets has a bracket base with a slot disposed longitudinally therethrough and a fastener having a generally flat head portion secured to the inside wall of the longitudinal handle and generally flush therewith, said fastener further comprising a threaded portion projecting through said wall and said slot and a releasable locking member mounted to said threaded portion on the exterior of said wall.

13. The tool holding apparatus of claim 7 wherein said longitudinal handle is tapered and has a greater inner diameter at its lower open end than at its upper end, the interior surface of said handle having a plurality of longitudinal ridges to secure an end of a pole inserted into said handle.

14. The tool holding apparatus of claim 7 wherein said bracket has a bracket base and a stop projecting from each end of said bracket base, each stop on one bracket base having a different length and said bracket being releasably mounted to the wall of the longitudinal handle so that the stops projecting from a bracket base can be alternated to vary the length of the stop projecting into the path of rotation of the tubular support member.

* * * * *

UNITED STATES PATENT AND TRADEMARK OFFICE

CERTIFICATE OF CORRECTION

PATENT NO. :5,255,405

DATED :October 26, 1993

INVENTOR(S) :Soren Samuelsson and Patrick A. Smahlik

It is certified that error appears in the above—identified patent and that said Letters Patent is hereby corrected as shown below:

Column 9, claim 1, line 22, "rotatably" should read --rotatable--

Signed and Sealed this

Fourteenth Day of June, 1994

Bruce Lehman

*Attest:*

BRUCE LEHMAN

*Attesting Officer*

*Commissioner of Patents and Trademarks*